US008088443B2

(12) United States Patent
Wagner et al.

(10) Patent No.: US 8,088,443 B2
(45) Date of Patent: Jan. 3, 2012

(54) EMULSIFICATION OF CONCENTRATED DISPERSIONS OF COLLOIDAL AND NANOPARTICLES

(75) Inventors: Norman J. Wagner, Newark, DE (US); Caroline H. Nam, Newark, DE (US)

(73) Assignee: University of Delaware, Newark, DE (US)

( * ) Notice: Subject to any disclaimer, the term of this patent is extended or adjusted under 35 U.S.C. 154(b) by 34 days.

(21) Appl. No.: 12/570,664

(22) Filed: Sep. 30, 2009

(65) Prior Publication Data

US 2010/0093240 A1 Apr. 15, 2010

Related U.S. Application Data

(63) Continuation of application No. 11/758,384, filed on Jun. 5, 2007, now abandoned.

(60) Provisional application No. 60/811,339, filed on Jun. 6, 2006.

(51) Int. Cl.
*B05D 1/18* (2006.01)
*C08K 3/00* (2006.01)

(52) U.S. Cl. ..... 427/343; 442/59; 523/502; 524/801

(58) Field of Classification Search ..... 427/343; 442/59; 523/502
See application file for complete search history.

(56) References Cited

U.S. PATENT DOCUMENTS

| | | | | |
|---|---|---|---|---|
| 3,649,426 | A * | 3/1972 | Gates, Jr. | 428/68 |
| 3,833,952 | A | 9/1974 | Rosenberg | |
| 4,503,952 | A | 3/1985 | Hesse | |
| 4,759,428 | A | 7/1988 | Seshimo | |
| 5,096,711 | A | 3/1992 | Dookhith et al. | |
| 6,358,909 | B1 | 3/2002 | Ochomogo et al. | |
| 2001/0049902 | A1 | 12/2001 | Varadaraj et al. | |
| 2004/0171321 | A1 | 9/2004 | Plant | |
| 2006/0234572 | A1 | 10/2006 | Wagner et al. | |

FOREIGN PATENT DOCUMENTS

| | | | |
|---|---|---|---|
| WO | WO-03/022085 | | 3/2003 |
| WO | WO-2004/103231 | A1 | 12/2004 |
| WO | WO-2007/100312 | A2 | 9/2007 |

OTHER PUBLICATIONS

Barnes, H. A., "Shear-thickening ("dilatancy") in suspensions of nonaggregating solid particles dispersed in newtonian liquids", Journal of Rheology, 1989, vol. 33, No. 2, pp. 329-366.

Egres, R. G., et al., "Novel flexible body amor utilizing shear thickening fluid (STF) composites", Proceedings of 14th International Conference on Composite Materials, San Diego, CA, Jul. 14-18, 2003.

Lee, Y. S., et al., "Dynamic properties of shear thickening colloidal suspensions", Rheologica Acta, 2003, pp. 1-19.

Lee, Y. S., et al., "The ballistic impact characteristics of Kevlar® woven fabrics impregnated with a colloidal shear thickening fluid", Journal of Materials Science, 2003, vol. 38, 2825-2833.

* cited by examiner

*Primary Examiner* — Tae H Yoon
(74) *Attorney, Agent, or Firm* — Connolly Bove Lodge & Hutz LLP

(57) ABSTRACT

A process to coat a shear thickening fluid onto a material which comprises emulsifying dispersions of a shear thickening fluid (STF) dissolved in a miscible carrier fluid or a partially miscible carrier fluid to form an emulsion and applying said emulsion to the material. The invention also relates to a suspoemulsion containing a shear thickening fluid which has been emulsified in a volatile solvent. The invention further relates to a method coating a material. The invention further relates to a method of a coating a material with the suspoemulsion.

20 Claims, 2 Drawing Sheets

Figure 1: Images of the A) Heptane STF mixture, B) Water-surfactant mixture, C) Emulsion as formed.

EMULSIFICATION OF CONCENTRATED DISPERSIONS OF COLLOIDAL AND NANOPARTICLES

RELATED APPLICATIONS

This application is a continuation of U.S. patent application Ser. No. 11/758,384, filed Jun. 5, 2007, which claims benefit to U.S. Provisional Application No. 60/811,339 filed Jun. 6, 2006, both application are incorporated by reference in their entirety for all useful purposes.

BACKGROUND OF THE INVENTION

Shear thickening fluids (STFs) are fluids whose viscosity increases with shear rate. Of particular interest are discontinuous STFs, which at high shear rates transform into a material with solid-like properties. A typical example of a discontinuous STF is a stabilized suspension of rigid colloidal particles with a high loading fraction of particles. Such systems have been studied for many different combinations of fluid matrix and particle size and compositions (Egres, R. G., Lee, Y. S., Kirkwood, J. E., Kirkwood, K. M., Wetzel, E. D., and Wagner, N. J., "Novel flexible body armor utilizing shear thickening fluid composites." Proceedings of 14$^{th}$ International Conference on Composite Materials. San Diego, Calif. Jul. 14-18, 2003), (Lee, Y. S., Wagner, N. J., "Dynamic properties of shear thickening colloidal suspensions," Rheol Acta 42, 199-208 (2003), (Shenoy, S., Wagner, N. J., Bender, J. W., "E-FiRST: Electric field responsive shear thickening fluids," Rheo Acta 42, 287-294 (2003), Barnes "Shear-thickening ("dilatancy") in suspensions of nonaggregating solid particles dispersed in Newtonian liquids", J. Rheology 33, 329-366 (1989)). The shear thickening in the colloidal suspension is due to the formation of jamming clusters, or hydroclusters, (Lee, Y. S., Wagner, N. J., "Dynamic properties of shear thickening colloidal suspensions," Rheol Acta 42, 199-208 (2003)) bound together by hydrodynamic lubrication forces. The hydrocluster growth and collision eventually result in a percolated arrangement of the rigid particles across macroscopic dimension. This microstructural transformation leads to the bulk solid-like behavior. Upon relaxation of the applied stresses, the rigidized material typically relaxes to the low strain rate, fluid-like behavior (Eric D. Wetzel, Y. S. Lee, R. G. Egres, K. M. Kirkwood, J. E. Kirkwood, and N. J. Wagner, "The Effect of Rheological Parameters on the Ballistic Properties of Shear Thickening Fluid (STF) KEVLAR®Composites" NUMIFORM, 2004).

Shear-thickening fluids have been shown to have utility in the fabrication of energy dissipative devices, such as shock absorbers (Hesse, H., U.S. Pat. No. 4,503,952), (Rosenberg, B. L., U.S. Pat. No. 3,833,952), (Sheshimo, K., U.S. Pat. No. 4,759,428) and more recently in the fabrication of ballistic fabric composites (Egres, R. G., Lee, Y. S., Kirkwood, J. E., Kirkwood, K. M., Wetzel, E. D., and Wagner, N. J., "Novel flexible body armor utilizing shear thickening fluid composites." Proceedings of 14$^{th}$ International Conference on Composite Materials. San Diego, Calif. Jul. 14-18, 2003), (Lee, Y. S., Wetzel, E. D., and Wagner, N. J., "The ballistic impact characteristics of KEVLAR® woven fabrics impregnated with a colloidal shear thickening fluid", *J. Mat. Sci.* 38, 2825-2833 (2003), (Eric D. Wetzel, Y. S. Lee, R. G. Egres, K. M. Kirkwood, J. E. Kirkwood, and N. J. Wagner, "The Effect of Rheological Parameters on the Ballistic Properties of Shear Thickening Fluid (STF) KEVLAR® Composites" NUMIFORM, 2004). There is considerable interest in incorporating STF's into other materials. PCT/US2004/015813 entitled "Advanced Body Armor using a shear thickening fluid" is incorporated by reference in its entirety for all useful purposes. Incorporation of STF's into plastics, rubbers and foams is discussed below. Shear thickening fluids may also contain fillers, see PCT application no. US06/04581 filed Feb. 9, 2006, which is incorporated by reference in its entirety for all useful purposes.

Within the scope of this invention, the shear thickening fluid is defined as any fluid that exhibits an increase in viscosity with increasing shear rate or applied stress. Shear thickening is not shear dilatancy, which is a material property whereby the material's volume changes upon an applied stress or deformation. Shear thickening fluids, however, may exhibit dilatancy under specific conditions.

Emulsions of two immiscible or partially miscible fluids have been extensively explored in several areas of research. Shear thickening "suspoemulsions" have been developed in a previous patent application (Wagner, Egres, Kirkwood, 2004 (U.S. Ser. No. 11/260,742 which is incorporated by reference in its entirety for all useful). However, the emulsification of highly concentrated dispersions of particles, such as shear thickening fluids (STFs), into volatile solvents, such as water, has not been reported previously, either in the aforementioned patent, or in the literature. Novel methods to emulsify dispersions into an immiscible or partially miscible carrier fluid are described in this patent application.

Typical processing of STF-fabric composites involves the use of copious amounts of a volatile solvent that can solubilize the STF, i.e., a co-solvent, such as ethanol (see prior art) to dilute the STF (approximate 50% by vol. silica particles dispersed in a polymeric matrix such as silicone oil). The use of ethanol not only poses potentially serious health and safety risks but also introduces process design challenges due to fire safety and VOC regulations. Further, the use of a co-solvent poses problems in that the particles can sediment out of the diluted solution, or the co-solvent may induce particle aggregation or precipitation. Despite these issues, ethanol is currently used in its present technology due to its benefits in STF-fabric processing: STF easily dissolves in ethanol and thus allows for ease in coating and manufacturing; ethanol can easily be removed to leave behind only STF in fabrics. The use of water instead of ethanol would eliminate any safety or health hazards. However, as environmentally stable STFs are formulated with water insoluble or sparingly water soluble carrier fluids, water cannot be directly used as a co-solvent to dilute the STF. Hence, the challenge is to develop a method whereby a STF can be emulsified as a dispersed phase in an aqueous solution. An emulsion refers to a state of matter whereby a fluid phase, which may contain multiple components including particles, polymer, and or surfactants, is dispersed as droplets in an insoluble or sparingly soluble fluid. Further, the subsequent challenge is to maintain the stability of the emulsion as well as the integrity of the STF phase upon drying or separation of the aqueous carrier fluid. Neither of these specific challenges has been addressed in the literature.

SUMMARY OF THE INVENTION

This invention is a new process that was inspired by the need to improve coating conditions of shear thickening fluids to materials such as conventional body armor or ballistic material or commercial materials such as polyolefins, nylons and polyesters. Conventional body armor materials are typically comprised of many layers of polyaramid poly (phenylene diamine terephthalamide) fabric, sold by DuPont under the registered name of KEVLAR®, with optional ceramic tile inserts.

An object of this invention enables coating of STFs into fabrics, such as required in continuous manufacturing of materials.

The most significant limitation is the stability of the emulsions. Coalescence and sedimentation can occur on the timescale of the use of the emulsion. However, stability can be improved by the use of various surface active agents, such as surfactants, polymers, particles or by changing the blending conditions or composition.

This invention has immediate applications in improving the manufacture of body armor composites as described above. The invention also has implications in the fields of dispersion science, colloid science, emulsion science, and food science. The most significant current limitation is the stability of the emulsions. However, stability can be improved by conducting more experiments with various surfactants and other stabilizing agents, different formulations, and variations in processing conditions.

This is the first time a shear thickening fluid has been emulsified into a volatile solvent to form an emulsion suitable for a coating process.

Briefly, the methods can also entail the use of a co-solvent for the STF such as, but not limited to heptane, toluene, or alcohols to lower the viscosity of the particle dispersion and a surfactant dissolved in an immiscible carrier fluid, such as water. Different techniques can be used to achieve an emulsion: sonication and/or mechanical mixing, or the use of microfluidic devices or 3-way junction, i.e. T-Junction or Y-Junction devices.

DETAILED DESCRIPTION OF THE INVENTION

Figure 1:
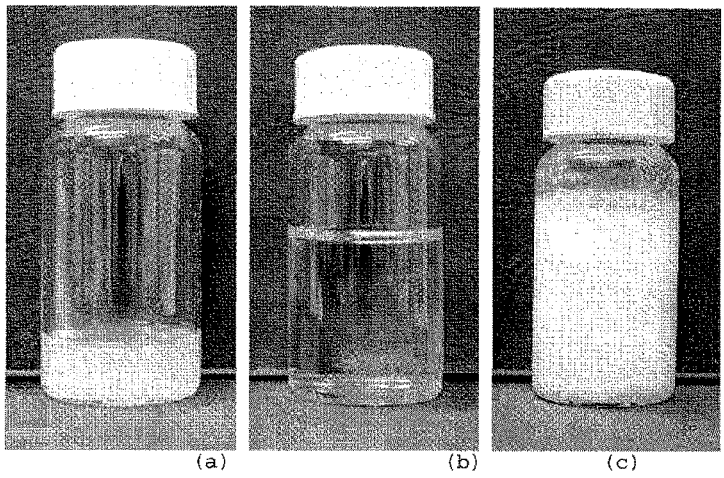
FIG. 1: Images of the A) Heptane STF mixture, B) Water-surfactant mixture, C) Emulsion as formed.

The emulsification process of water and STF was found to require a pre-treatment of the highly viscous fluid and certain amount of energy that can be achieved from an ultrasonic bath, horn sonication, or heavy duty blending.

STFs are known in the art and are disclosed in Wagner et al, U.S. Ser. No. 11/260,742 and Wagner et. al., PCT application no. US06/04581 filed Feb. 9, 2006 which are again incorporated by reference in their entirety.

The stabilization process was aided by a surfactant. Surfactants are disclosed in the following references which are incorporated by reference in their entirety: (*Kirk-Othmer Encyclopedia of Chemical Technology* "Surfactants", by Tharwat Tadros Copyright© 2006 by John Wiley & Sons, Inc., DOI: 10.1002/0471238961.1921180612251414.a01.pub2, Article Online Posting Date: Jul. 14, 2006) and Flick, Ernest W., "Industrial Surfactants" 2$^{nd}$ edition, © 1993, publisher, William Andrew Publishing/Noyes (Flick, "Industrial Surfactants").

The preferred surfactants are those that have a suitable hydophilic/lyophilic balance (HLB), preferably from 8 to 18 and more preferably typically around 15. (*Kirk-Othmer Encyclopedia of Chemical Technology*, "Emulsions" by Edward Kostansek, Rohm and Haas Co., Copyright© 2003 by John Wiley & Sons, Inc. All rights reserved. DOI: 10.1002/0471238961.0513211206180902.a01.pub2, Article Online Posting Date: Jul. 18, 2003

These include, but are not limited to Pluronic™ L64 and others from the Pluronic™ family of similar or higher HLB (BASF), Triton-X705 or others from the Triton™ family with similar HLB (Dow). Other nonionic, anionic, cationic or zwitterionic surfactant suitable for forming aqueous emulsions of insoluble oils may be used depending upon the specific STF carrier fluid composition. Similarly, nonionic, anionic, or cationic polymers may also be employed, again depending on the specific STF carrier fluid composition. Stability can also be achieved through the use of particles, commonly known as a pickering emulsion. These particles may be the same as those comprising the STF, or may be specifically chosen to stabilize the oil-water interface. Other "Surfactants can be chosen from among those recommended by standard industrial practice handbooks, such as Flick "Industrial Surfactants".

In the case of a water like system, the surfactant would have an HLB of about 8 to about 20, preferably around 15. In the case of an oil like system, the surfactant would have an HLB of about 3 to about 8, (See *Kirk-Othmer Encyclopedia of Chemical Technology*., "Emulsions" by Edward Kostansek, Rohm and Haas Co., Copyright© 2003 by John Wiley & Sons, Inc. DOI: 10.1002/0471238961.0513211206180902.a01.pub2, Article Online Posting Date: Jul. 18, 2003

Water like, would include water and aqueous soluble solvents such as alcohols.

The materials that can be used are conventional body armor or ballistic material. Conventional body armor materials are typically comprised of many layers of polyaramid poly (phenylene diamine terephthalamide) fabric, sold by DuPont under the registered name of KEVLAR®, with optional ceramic tile inserts.

One type of material would include reactive polymeric materials that cure or crosslink to form solids. Reactive polymers include polyurethanes that cure through the chemical reaction of components (polyols and isocyanates), epoxies that cure through the addition of a catalyst, and UV curable resins. A preferred second material of this type would be from the class of elastomeric or elastomeric gel materials, such as silicone rubber (cross-linked PDMS) or silicone gels and the like, which can be relatively low viscosity liquids prior to cross-linking, whereafter they form resilient materials with good rebound characteristics. A variety of elastomers exist to provide a wide range of properties such as chemical and solvent resistance, temperature resistance, and hardness (durometer). These materials could be mixed with shear thickening fluids at room temperature to disperse the shear thickening fluids adequately and to achieve the desired composite morphology or shear thickening fluid droplet size. The liquid-like second material could subsequently be cured, or the curing could be accelerated through heating or the addition of additional components that catalyze the reaction and transform the second material into a solid. Curing could be accomplished by UV. Further, the liquid could be gelled by physical and or chemical crosslinking of polymers or by the addition of structure forming agents, such as fumed silica.

Another type of materials would include melt processable polymers or thermoplastic elastomers (TPE). Melt processable polymers include but are not limited to polyolefins such as polyethylene and polypropylene, nylon, polymethylmethacrylate, polyvinylchloride, polyethylene, polyesters such as but not limited to terephthalate (PET), polycarbonate and the like. Thermoplastic elastomers would include such as materials as those sold under the trade names Santoprene™ (Exxon Mobil Chemical), Hytrel® (DuPont Company), and Engage™ from DuPont-Dow Elastomers. In this instance, increased temperature is used to liquefy a polymeric material. At the processing conditions required to achieve the desired melt flow properties of the polymer second material, the shear thickening fluid would be compounded with the polymer melt to achieve the desired level of mixing and microstructure. The temperature would subsequently be reduced to generate the solid polymer-shear thickening fluid composite.

The pre-treatment of the STF involved dissolving the STF in a co-solvent such as but not limited to alcohol, alkanes, such as heptane and hexane, or toluene. Any soluble or partially material that does not adversely affect the STF properties can be employed.

This boiling point of this co-solvent needs to be lower than the boiling point of the solvent component of the STF, which in this case, is a silicone oil. The amount of co-solvent should also be minimized, but sufficient to enable the STF to be emulsified. A preferred amount of co-solvent is around 10% by volume in order to avoid any significant processing issues and to ease the evaporation of the co-solvent.

EXAMPLE

As a specific example, 150 mL of STF (50% 450 nm silica particles (Shokubai, KEP-50, Nissan Chemical) dispersed in polytrimethicone (PTM-20, ISP, Inc.) and 15 mL of heptane (reagent grade, Fischer Scientific) were mixed by hand-shaking the container for 1 minute and subsequently, placing the container on a roll-mixer for 10 minutes. In a separate stock solution container, 0.5 g of a surfactant (Pluronic L64, BASF) was dissolved in 1000 mL of deionized water. To ensure that the surfactant fully dissolved in the water, the stock solution was placed in the ultrasonic bath for 1 hour under heating to 35° C. 585 mL of the water/surfactant mixture was then added to the STF/heptane mixture. This mixture was then placed in an ultrasonic bath at approximately 35° C. for 1 hour. The mixture was then hand-shaken for 1 minute after sonication. The result is shown in FIG. 1 as a uniform, white, low viscosity fluid with water as the continuous phase.

The emulsion as prepared appears uniform for approximately 5-10 minutes, where upon a dense layer appears to form at the bottom, while a clear layer of water forms at the top. These phases continue to grow at the expense of the emulsion. Some emulsion is still evident after 24 hours. Upon shaking or stirring, the emulsion can be regenerated.

Figure 2:
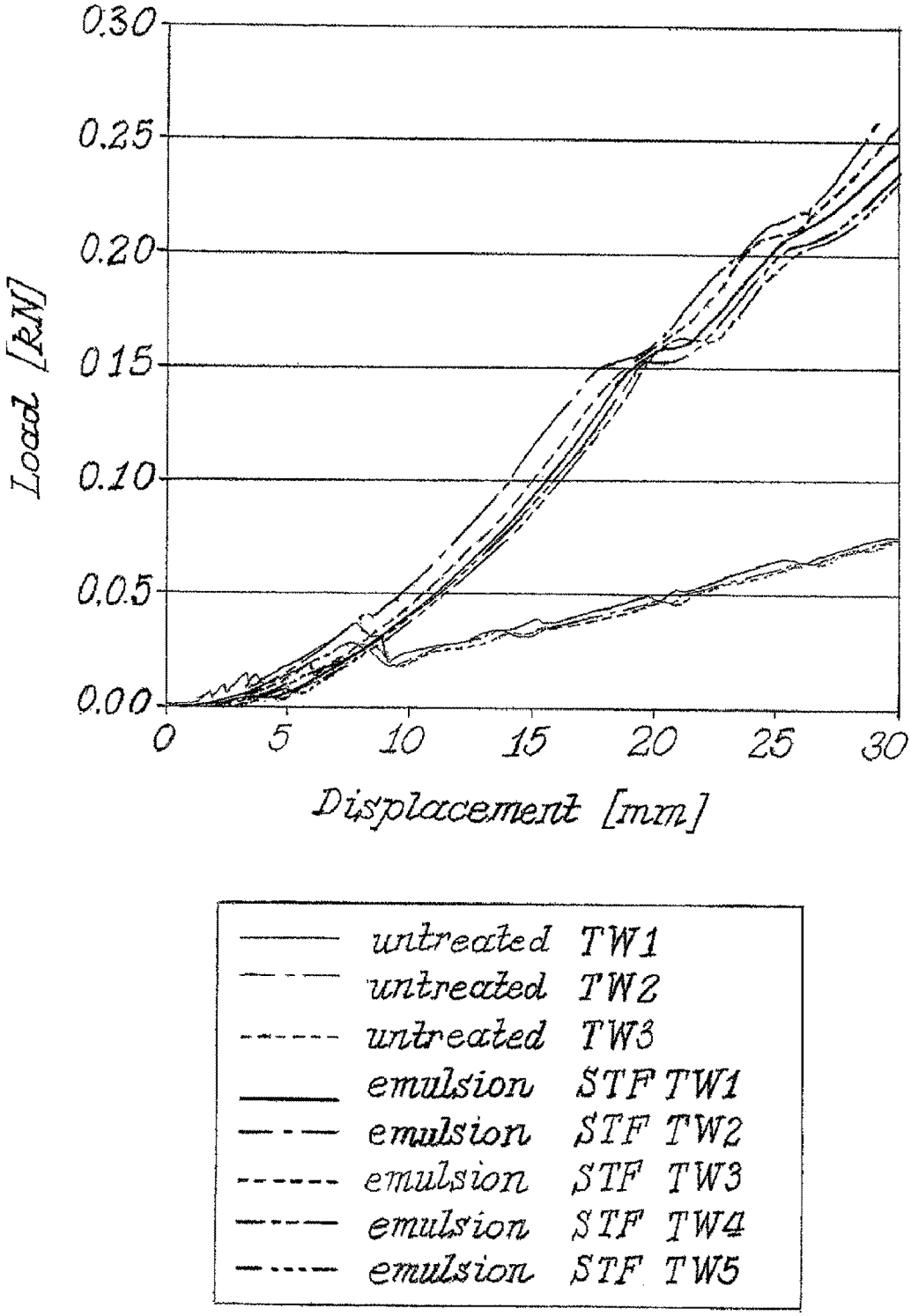
FIG. 2. Quastistatic testing results for untreated and STF intercalated Twaron showing load versus displacement.

As a specific application of the above mixture, the emulsion as prepared was placed in a dip coating pan for STF-fabric manufacturing. A standard procedure, previously published was followed. (Egres, et al., STAB PERFORMANCE OF SHEAR THICKENING FLUID (STF)—FABRIC COMPOSITES FOR BODY ARMOR APPLICATIONS, Proceedings of SAMPE 2005: New Horizons for Materials and Processing Technologies. Long Beach, Calif. 1-5 May 2005). The fabric used was a 15"×15" sheet of Twaron (1011-123.0-1002, provided by Barrday, Inc.). The fabric was submerged in the emulsion for 1 minute and then drawn through a set of 2 rubber nip-rollers to remove excess fluid. The sheet was then hung-dried for 30 minutes upon which it was further dried in an oven at 80° C. for 30 minutes. The final weight addition of STF to the fabric was 24%. The STF-Twaron composite was then cut into four 7.5"×7.5" pieces which were stacked for quasistatic (QS) spike resistance testing. Four untreated sheet were also tested for comparison. An Intron 4201 was used to measure load. An NIJ-standard spike was used as the impactor and pushed into the fabric sample at 5 mm/min. Backing material is a multilayer foam and witness paper support, the details of which is outlined in NIJ Standard 0115.0. FIG. 2 illustrates load vs. displacement of the treated Twaron and untreated Twaron. These preliminary results show that the STF-water emulsion has efficacy in successfully impregnating fabrics for spike resistance.

All the references described above are incorporated by reference in its entirety for all useful purposes.

While there is shown and described certain specific structures embodying the invention, it will be manifest to those skilled in the art that various modifications and rearrangements of the parts may be made without departing from the spirit and scope of the underlying inventive concept and that the same is not limited to the particular forms herein shown and described.

We claim:

1. A process to intercalate a shear thickening fluid onto a material which comprises emulsifying a shear thickening fluid (STF) dispersed in a water like system which comprises water and optionally an aqueous soluble solvent to form an emulsion and applying said emulsion to the material.

2. The process as claimed in claim 1, wherein the material is a ballistic material.

3. The process as claimed in claim 1, wherein the material is a nylon, polyolefin or polyester.

4. The process as claimed in claim 1, wherein the material is a poly (para-phenylene terephthalamide) fabric.

5. The process as claimed in claim 1, where the water like system comprises water.

6. The process as claimed in claim 1, where the water like system comprises water and the material is a nylon, polyolefin or polyester.

7. The process as claimed in claim 1, which the STF further comprises a co-solvent.

8. The process as claimed in claim 7, wherein the cosolvent is an alkane.

9. The process as claimed in claim 7, wherein the cosolvent is heptane, hexane or toluene.

10. The process as claimed in claim 1 where a surfactant is used to stabilize the emulsion.

11. The process as claimed in claim 1, wherein the emulsion is created by sonicating or mechanical mixing.

12. The process as claimed in claim 1, wherein said emulsion is a suspoemulsion.

13. The process as claimed in claim 1, wherein the material comprises a polyolefin.

14. The process as claimed in claim 1, wherein the material comprises a polyethylene, polypropylene, nylon, polymethylmethacrylate, polyvinylchloride, polyethylene terephthalate (PET) or polycarbonate.

15. The process as claimed in claim 1 wherein the material comprises nylon.

16. The process as claimed in claim 1, wherein the material comprises polyester.

17. The process as claimed in claim 1, which the STF further comprises a cosolvent wherein the cosolvent is an alkane and the water like system comprises water.

18. The process as claimed in claim 1, wherein the material comprises a polyethylene, polypropylene, nylon, polymethylmethacrylate, polyvinylchloride, polyethylene terephthalate (PET) or polycarbonate, and the STF further comprises a cosolvent wherein the cosolvent is an alkane and the water like system comprises water.

19. The process as claimed in claim 1, wherein the water like system comprises water and alcohol.

20. The process as claimed in claim 9, which the water like system further comprises a surfactant with an HLB value of about 8 to about 20.

* * * * *